US009637274B2

(12) United States Patent
McClaskey

(10) Patent No.: US 9,637,274 B2
(45) Date of Patent: May 2, 2017

(54) CADDIES FOR BOXED BEVERAGES, ESPECIALLY CADDIES FOR BOXED WINE PRODUCTS

(71) Applicant: Box Wine Caddy, Inc., Parkville, MD (US)

(72) Inventor: James McClaskey, Parkville, MD (US)

(73) Assignee: Box Wine Caddy, Inc., Parkville, MD (US)

( * ) Notice: Subject to any disclaimer, the term of this patent is extended or adjusted under 35 U.S.C. 154(b) by 5 days.

(21) Appl. No.: 14/878,665

(22) Filed: Oct. 8, 2015

(65) Prior Publication Data

US 2016/0107797 A1 Apr. 21, 2016

Related U.S. Application Data

(60) Provisional application No. 62/066,626, filed on Oct. 21, 2014, provisional application No. 62/064,203, filed on Oct. 15, 2014.

(51) Int. Cl.

| | |
|---|---|
| ***B67D 1/16*** | (2006.01) |
| ***B65D 25/24*** | (2006.01) |
| ***B65D 19/00*** | (2006.01) |
| ***B65D 77/06*** | (2006.01) |
| ***B65D 1/34*** | (2006.01) |

(52) U.S. Cl.

CPC ..... *B65D 25/24* (2013.01); *B65D 1/34* (2013.01); *B65D 19/0002* (2013.01); *B65D 77/067* (2013.01); *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/00805* (2013.01)

(58) Field of Classification Search

CPC .... B67D 2001/0827; B67D 2001/0828; B67D 3/008; B67D 3/0087; B67D 1/0889; B67D 1/0891; B67D 1/0892; B67D 7/84; B67D 7/845; B65D 19/0002; B65D 19/22; B65D 19/42; B65D 19/44; B65D 25/24; B65D 25/48; B65D 85/72; F16M 11/048

USPC ..... 222/105, 106, 192, 108, 160, 173, 185.1

See application file for complete search history.

(56) References Cited

U.S. PATENT DOCUMENTS 188,560 A * 3/1877 Wright ..... B67D 1/16 222/108

221,143 A * 11/1879 Allen ..... B67D 1/06 222/160

(Continued)

OTHER PUBLICATIONS

Boxed wine holder(wine box, wine dispenser, wine server), Etsy, accessed Oct. 23, 2014, Web.

(Continued)

*Primary Examiner* — J. Casimer Jacyna
*Assistant Examiner* — Benjamin R Shaw
(74) *Attorney, Agent, or Firm* — Whitham, Curtis & Cook, P.C.

(57) ABSTRACT

A caddy, into which is received a boxed-wine product, displays the boxed-wine product and permits easy access to the on/off spigot of the boxed-wine product, while protecting furniture and flooring in a vicinity of the boxed-wine product from drippage, and also protecting a surface from being scratched by the boxed-wine product. An open, roofless caddy is especially provided.

11 Claims, 6 Drawing Sheets

(56) References Cited

U.S. PATENT DOCUMENTS 508,327 A * 11/1893 Lippincott ..... B67D 1/06 222/160
603,856 A * 5/1898 Mower ..... A47K 5/10 222/165
1,772,111 A * 8/1930 Rice ..... B67D 1/06 222/108
3,232,489 A * 2/1966 Buffington ..... B67D 1/06 211/150
3,940,019 A * 2/1976 Kross ..... B67D 1/0041 222/108
4,262,821 A * 4/1981 Smrt ..... B65D 83/203 118/305
4,271,987 A * 6/1981 Eriksson ..... B67D 1/108 222/160
D353,977 S 1/1995 Muschett
6,131,767 A * 10/2000 Savage ..... B67D 3/043 222/1
6,413,618 B1 * 7/2002 Parker ..... B32B 3/14 428/195.1
7,380,410 B2 6/2008 Rand et al.
7,422,038 B2 * 9/2008 Boler, Jr. ..... A47L 13/51 137/313
D583,630 S 12/2008 Goodman et al.
8,464,913 B2 * 6/2013 Yoon ..... D06F 39/022 222/185.1
8,579,161 B2 * 11/2013 Steeb ..... A21C 5/006 222/146.6
8,733,594 B1 * 5/2014 White ..... B67D 3/0083 211/71.01
D736,084 S 8/2015 Carmona
2006/0157518 A1 * 7/2006 Havlovitz ..... A01C 15/02 222/617
2007/0145870 A1 * 6/2007 Uffner ..... A47B 31/00 312/257.1
2009/0078724 A1 * 3/2009 Lamb ..... B60P 3/0257 222/608
2010/0078448 A1 * 4/2010 Kpabar ..... B67D 3/0009 222/108
2011/0073615 A1 * 3/2011 Anderson ..... B67D 1/06 222/105
2012/0217266 A1 * 8/2012 Edwards ..... B65D 77/068 222/105
2012/0292346 A1 * 11/2012 Watson ..... D06F 39/022 222/185.1
2014/0239020 A1 * 8/2014 Lamb ..... B67D 1/0889 222/610
2015/0274500 A1 * 10/2015 Orita ..... B67D 3/0009 222/105

OTHER PUBLICATIONS

B. Battison, "Universal Wine Box Holder", Designspotter, accessed Oct. 23, 2014, Web.
E. Hagan, "How to Make a Classy Boxed Wine Holder", One Project Closer, Feb. 6, 2013, Web.
J. Hagan, "DIY Wine Box", One Project Closer, May 16, 2013, Web.

* cited by examiner

CADDIES FOR BOXED BEVERAGES, ESPECIALLY CADDIES FOR BOXED WINE PRODUCTS

FIELD OF THE INVENTION

The invention is directed to beverage dispensary, especially to dispensing wine contained in boxes such as 3-liter and 5-liter wine boxes.

BACKGROUND OF THE INVENTION

Over the years, boxed wines comprising a spigot have evolved into common usage as wine containers for household consumption, entertaining, etc.

Boxed-wine products are not without drawbacks, however. For example, the repetitious motions of pulling the boxed wine forward for dispensing and pushing it back when finished tend to scratch the surface, which is highly undesirable. Another disadvantage of boxed wine products is that wine tends to drip out of the spigot when no glass is present and the spigot is closed, which results in wine puddling in a vicinity of the boxed wine—such as on the floor, on furniture, on a table or tablecloth, on a counter top, on a refrigerator shelf, etc.

To easily access and use the boxed-wine beverage but without the above-mentioned disadvantages would be desirable.

SUMMARY OF THE INVENTION

The invention ameliorates the above-mentioned drawbacks of boxed-wine products, and in one inventive embodiment provides a caddy for a boxed beverage comprising: a base; a recess accommodating a size of a boxed wine product; and at least one roller (such as, e.g., a plurality of rollers, each roller being connected to the base; a set of support rollers that support a boxed wine product; etc.), such as, e.g., inventive caddies further comprising a drip tray (such as, e.g., a drip tray that extends forward from the base); inventive caddies further comprising a box stop; inventive caddies further comprising a notch a notch having a wine-glass-sized contour; inventive caddies further comprising at least one pad (preferably a non-skid pad); inventive caddies wherein the recess is defined only by the base and no roof section or top section is included above the recess; and other inventive caddies.

The invention in another preferred embodiment provides a caddy comprising: a recess for a boxed beverage, wherein a boxed-wine product comprising a spigot temporarily occupies the recess; a base, wherein the boxed-wine product temporarily sits on a top surface of the base, the base having a longer length than a length of the boxed-wine product; a set of rollers, wherein the boxed-wine product sits atop and contacts the rollers; a drip tray extending forwardly from the base; a box stop at a frontmost end of the drip tray and extending upwards from the drip tray; and a notch approximating a curvature of a wine glass, wherein the notch defines a center front section of the drip tray.

BRIEF DESCRIPTION OF THE DRAWINGS

The drawings herein (not to scale) are as follows.

DETAILED DESCRIPTION OF THE PREFERRED EMBODIMENT

The invention may be appreciated with reference to FIGS. 1-4 herein, which illustrate an inventive caddy 1 into which is received a boxed beverage product X. Preferably, the boxed beverage product comprises a spigot. Most preferably, the boxed beverage product is a boxed-wine product comprising a spigot.

Caddy 1 comprises a base 2. Examples of materials useable for constructing base 2 and other parts of caddy 1 are, e.g., plastic (such as, e.g., polypropylene, ABS, etc.), glass, porcelain, wood, metal, etc.

Above base 2 is a recess extending at least to sidewalling 3. Preferably sidewalling 3 has a certain non-zero height extending upwards from base 2. In less preferred embodiments, sidewalling 3 has minimal or no height upwards from base 2. A preferred height of side walls and back walls is about ¼-½ inch above the rollers, which is tall enough to confine the wine box and low enough not to hinder replacement of the box. Sidewalling 3 height below ⅛ inch is not preferred, because such a low height for sidewalling 3 is not considered effective to contain the wine box on the caddy 1.

When selecting dimensions for the base 2 and when constructing sidewalling 3, sufficient space must be left as a recess. A recess cannot be smaller than a size of the base 2 of the boxed wine product to be used in conjunction with caddy 1.

Sidewalling 3 preferably comprises a back wall section against which the backside of the wine box (i.e., not the spigot-containing side) will abut, whereby proper positioning of the wine box over drip tray 5 is provided, and further preferably comprises two side sections (parallel to each other and perpendicular to the back wall section) by which the wine box is kept contained on caddy 1.

Caddy 1 is shown with sidewalling 3 not being topped-off with a ceiling, roof, or the like. For caddy 1 to be without a ceiling or roof structure (and without the high sidewalls needed to accompany a ceiling or roof structure) is preferred.

Figure 1:
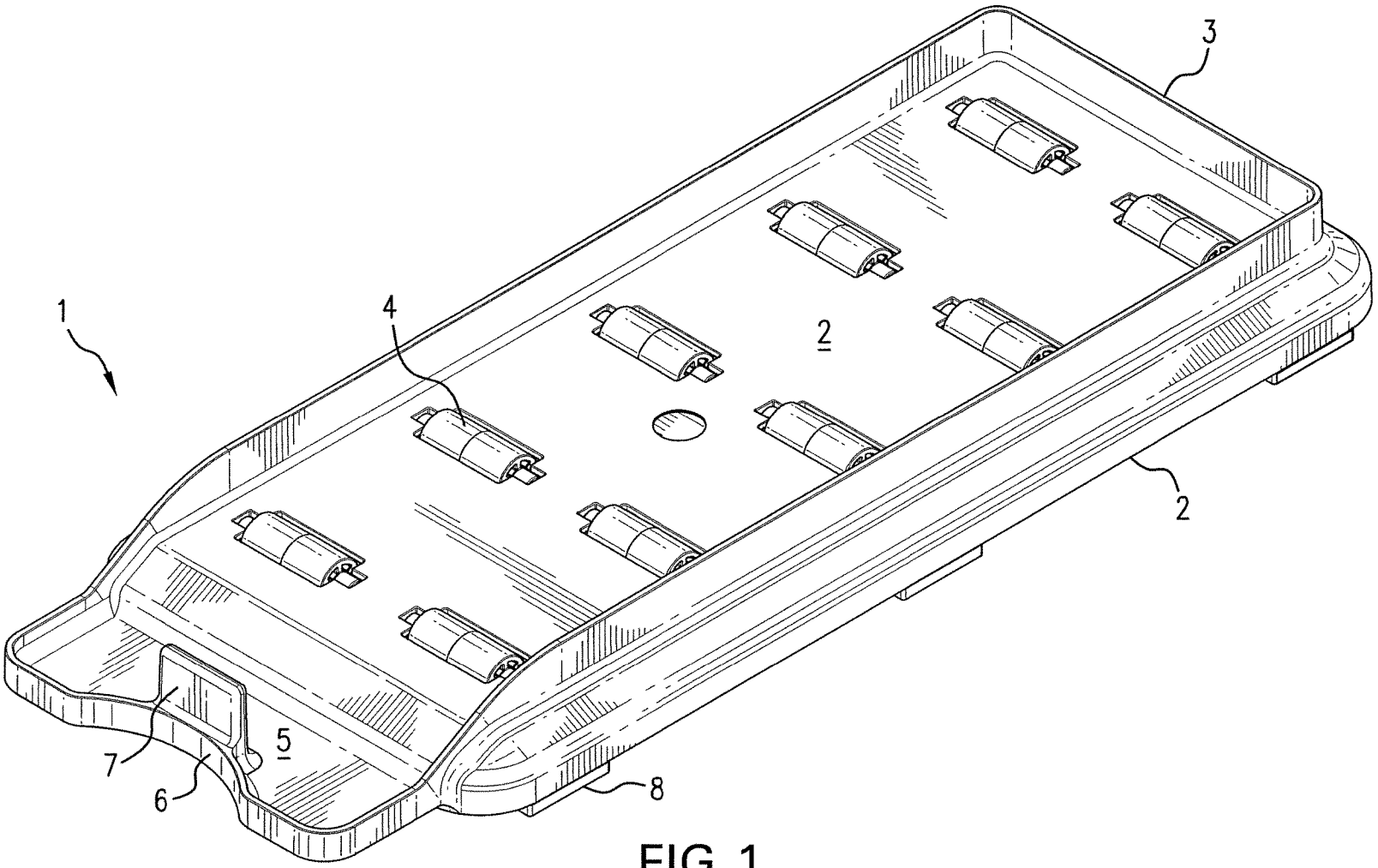
FIG. 1 is a top perspective view of a caddy 1 according to an embodiment of the invention.
Figure 2:
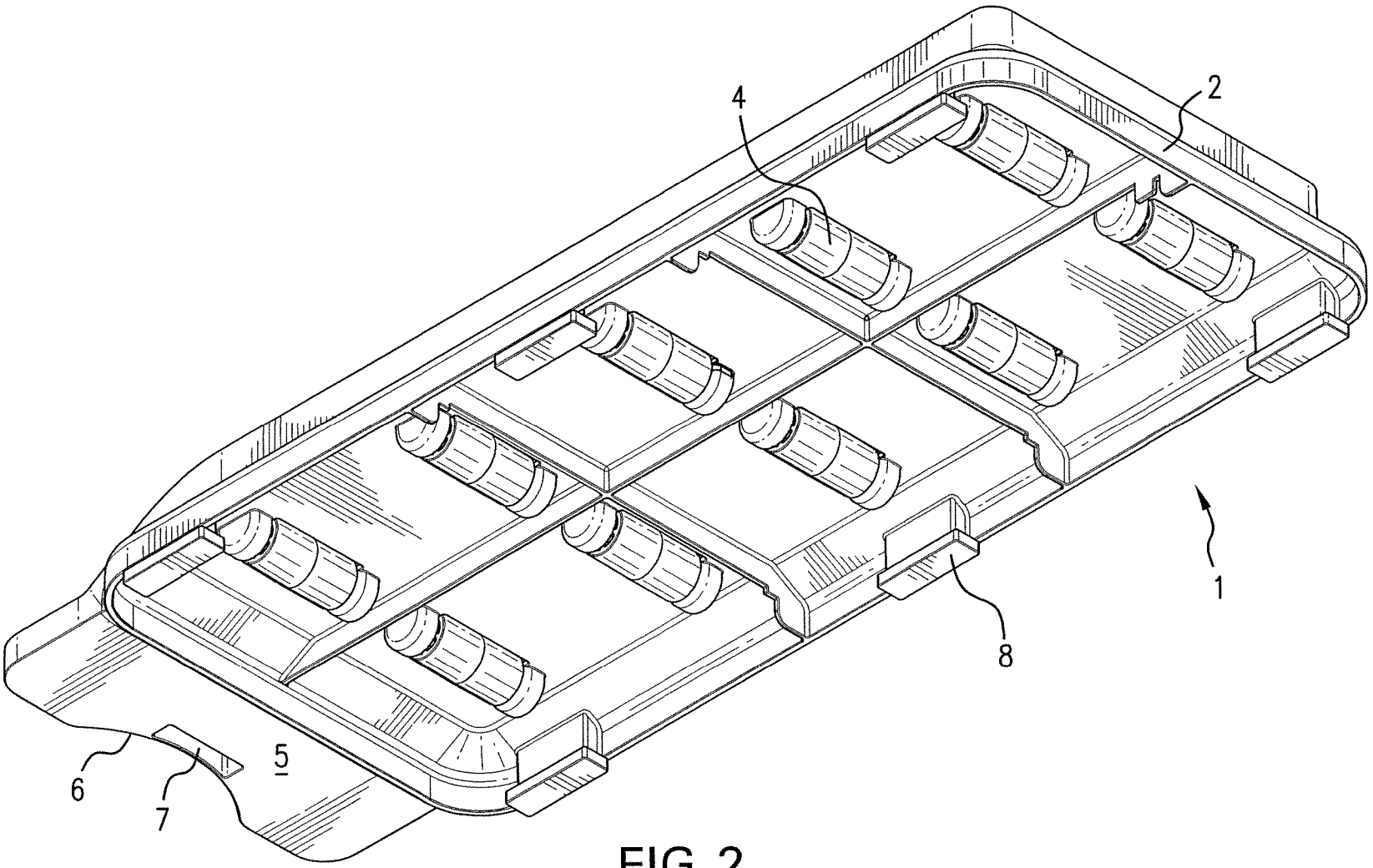
FIG. 2 is a bottom perspective view of caddy 1 of FIG. 1.
Figure 3:
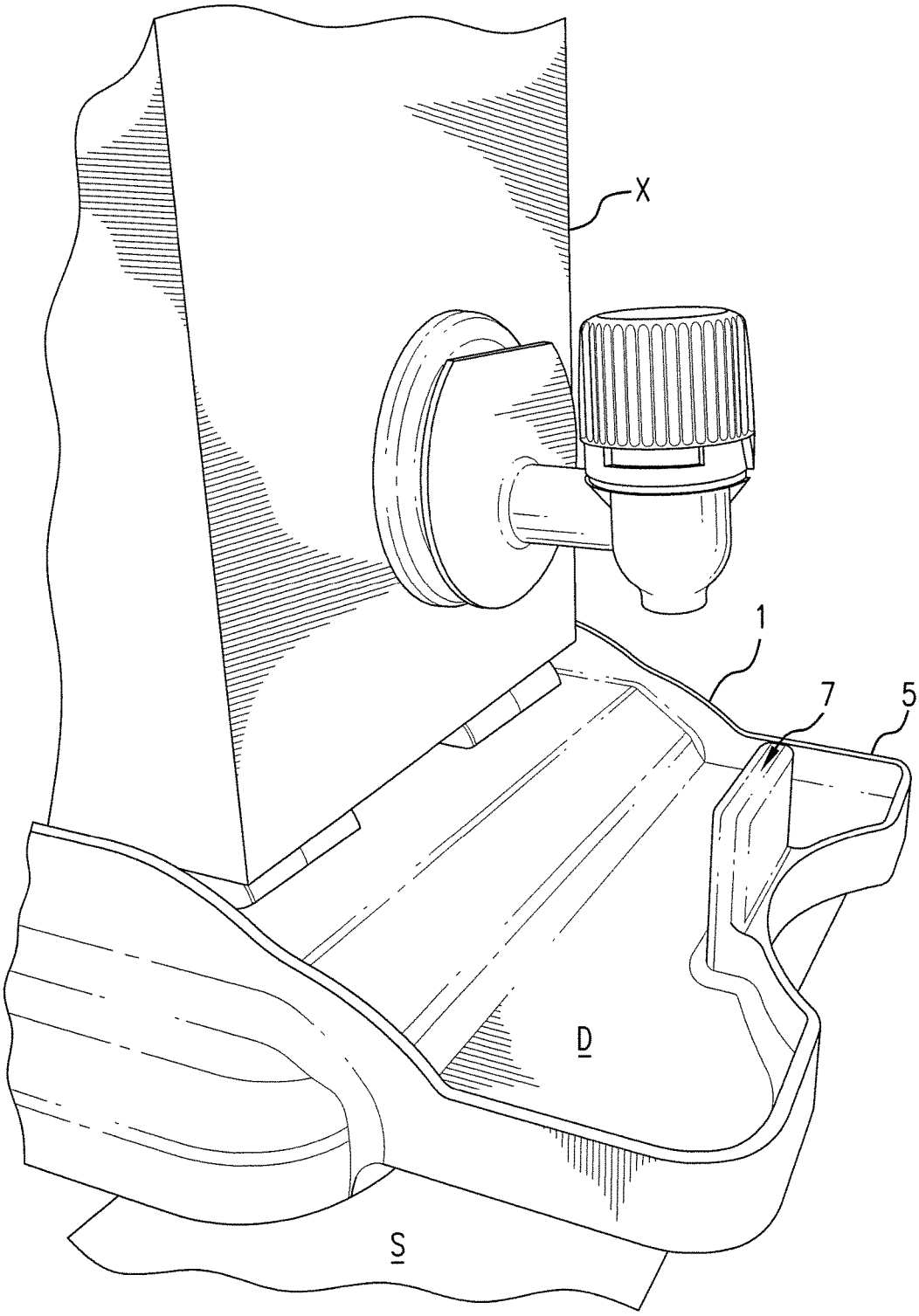
FIG. 3 is a perspective front, angled view of caddy 1 according to FIGS. 1-2 in usage with a boxed-wine product X, atop surface S.
Figure 4:
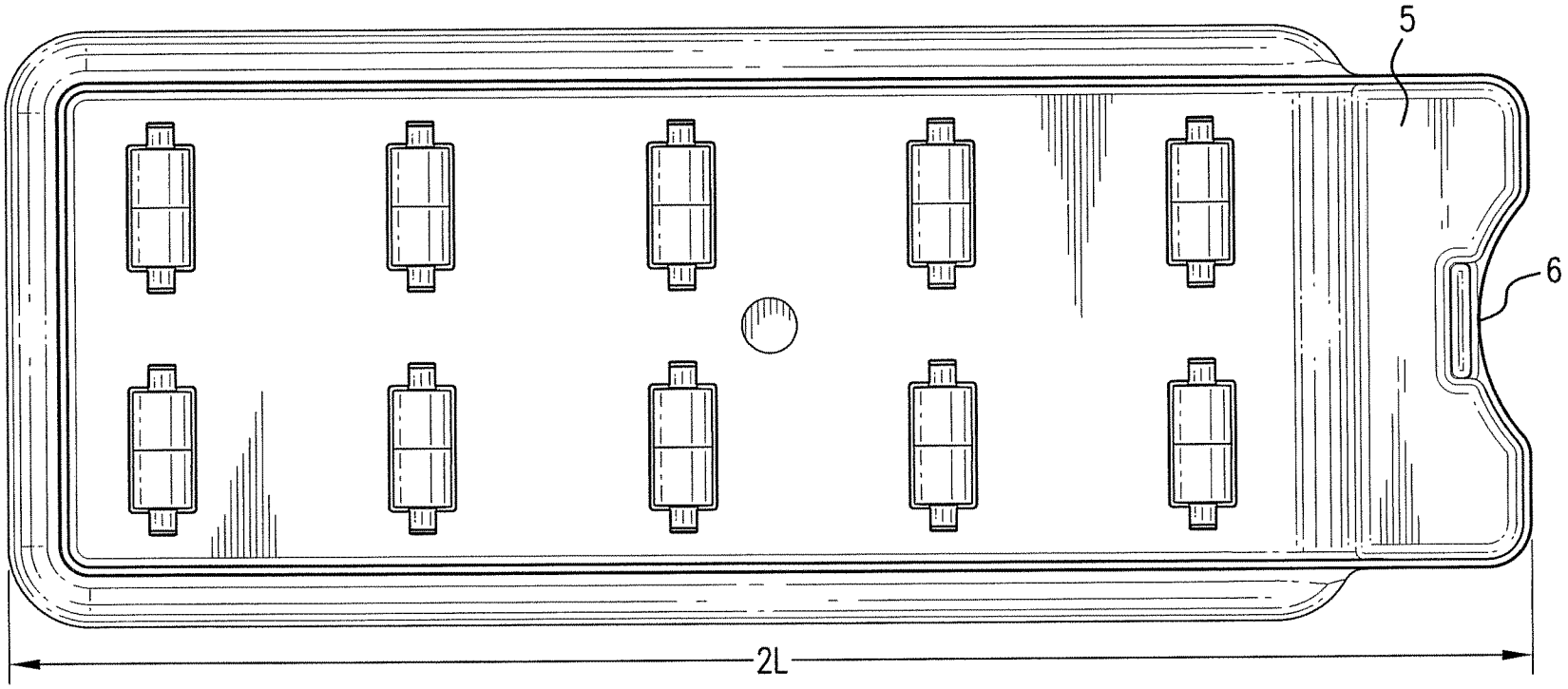
FIG. 4 is a top plan view of caddy 1 of FIG. 1.
Figure 5:
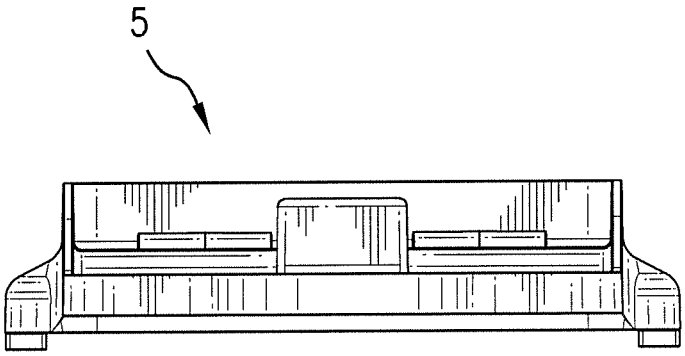
FIG. 5 is a cross-sectional front view of drip tray 5 (FIG. 4) of caddy 1.
Figure 7:
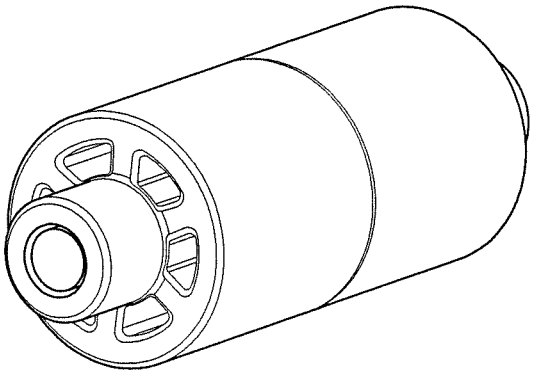
FIG. 7 is a perspective view of a roller useable as roller 4 in caddy 1.
Figure 6:
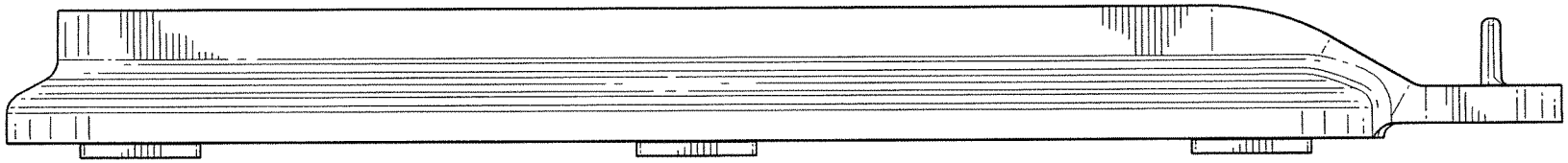
FIG. 6 is a cross-sectional side view of caddy 1.

Caddy 1 comprises rollers 4. The number of rollers 4 shown in FIGS. 1-2 is illustrative. To omit rollers 4 is not preferred. Rollers 4 support the box of wine, and facilitate movement of the box of wine, forward for dispensing and backward for storage. Each roller 4 is connected to base 2. Preferably each roller 4 is snapped into base 2. In other embodiments, alternatives to rollers are used such as, e.g., glides, slides, ball bearings, low-friction elements, stationary raised base, etc. Each roller 4 preferably comprises a roller shaft.

Drip tray 5 extends forward from base 2. Drip tray 5 catches dripped wine D (FIG. 3) from the boxed-wine spout when the box of wine is pushed to the back of base 2 after wine-dispensing. Drip tray 5 has an indent 6 on the front edge to accommodate the curve of a wine glass while dispensing. Preferably indent 6 is a circular indent and is a wine glass notch. A wine glass notch is a preferred feature, to align the glass to the wine box spout during dispensing.

Preferably drip tray 5's width is somewhat less than base 2's width. A preferred example is a base width of about 5.25 inches and a drip tray width of about 4.375 inches.

When constructing caddy 1, preferably the length 2L (FIG. 4) of the base 2 is somewhat longer than the length of a standard wine box, and the wine box can be easily slid forward and backwards, with a length of base 2 that accommodates peaking over the drip tray when the wine box is pushed back and also accommodates pulling forward of the wine box for dispensing. An example of a preferred length for base length 2L is 13 inches.

Preferably the front of caddy 1 is generally unwalled and generally open, such as generally unwalled and generally open except for a wine box stop.

Caddy 1 preferably comprises wine box stop 7. Wine box stop 7 preferably is sized and shaped so that box stop 7 limits the forward movement of the box of wine for dispensing. A height of stop 7 should be less than a height of where a wine box tap is situated, so that the tap clears the stop 7. A wine box stop is preferred to be included in caddy 1, to align the spout of the wine box in the correct position for dispensing and to contain the boxed wine within the confines of caddy 1.

Alternately, in some less preferred embodiments, a caddy is constructed without stop 7. If a caddy has no stop 7, preferably the caddy comprises relatively higher sidewalling 3, and/or a linear stop using a low friction technology (such as, e.g., a slide; a glide; ball bearings; etc.).

Caddy 1 comprises pads 8. Pads 8 preferably are constructed of a non-skid material such as rubber or other material that will provide a non-skid effect. Caddy 1 has its recess on a upward-facing side of caddy 1 and pads 8 are on an underside of caddy 1.

When caddy 1 is situated on a surface S, in usage, a boxed wine X is situated in the recess atop base 2 with a spout of the boxed wine X pointing in a direction that wine dripping from the spout falls into caddy 1 and not onto the surface S. Examples of surface S are, e.g., a countertop surface, a tabletop surface, a table-clothed surface, a wooden furniture surface; a glass surface; etc.

The invention further will be appreciated with reference to the following examples, without the invention being limited to the examples.

EXAMPLE 1

In this inventive example, a caddy for boxed wine products was constructed.

Tray base—a tray base was made of plastic, in a size and shape to accommodate, support and confine a box of wine within the caddy throughout dispensing and storage. It was designed for, but not limited to, a specific sized box of wine. The sides of the tray base are just high enough to help confine but low enough not to impede the removal or replacement of a box of wine. The bottom of the caddy has been flared out; the added contour provides strength and gives a wider footprint than the box of wine, for stability.

Transport rollers—these rollers are in the bottom of the tray base, and support the box of wine. Movement is permitted of the box of wine forward for dispensing and backward for storage. The transport rollers are selected to support weight of a 5-liter box of wine. Two rows of five rollers each were used in this example. Each roller in this example is made of one piece of plastic.

Box stop. —The box stop limits the forward movement of the box of wine for dispensing. The "dispense" position is when the box of wine is (manually) pulled forward to the box stop.

A drip tray. —A drip tray catches the drips from the boxed-wine spout when the box of wine is pushed to the back of the tray after dispensing. The drip tray has a circular indent on the front edge to accommodate the curve of a wine glass while dispensing.

The body and rollers in this example were made of plastic.

Non-skid pads. Rubber feet on the bottom of the caddy help support and prevent the caddy from sliding while in use. Using this caddy will help prevent scratches on surfaces which often occur when dispensing from an uncaddied box of wine. This example was constructed using 6 pads to accommodate a 5-liter boxed wine.

EXAMPLE 2 (Stackability)

The caddy of Example 1 further was constructed to be stackable. Underneath the caddy is a series of raised ridges (across and lengthwise) which strengthen the tray to support the weight of a box of wine. Notches in these raised ridges combined with the height of the box stop make like-sized caddies stackable for storage and shipping.

While the invention has been described in terms of its preferred embodiments, those skilled in the art will recognize that the invention can be practiced with modification within the spirit and scope of the appended claims.

What I claim as my invention is as follows:

1. A caddy comprising:

a recess for a boxed beverage, wherein a boxed-wine product comprising a spigot temporarily occupies the recess;

a base, wherein the boxed-wine product temporarily sits on a top surface of the base, the base having a longer length than a length of the boxed-wine product;

a set of rollers, wherein the boxed-wine product sits atop and contacts the rollers;

a drip tray extending forwardly from the base;

a box stop at a frontmost end of the drip tray and extending upwards from the drip tray;

a notch approximating a curvature of a wine glass, wherein the notch defines a center front section of the drip tray.

2. The caddy of claim 1, wherein each roller is snapped into the base.

3. The caddy of claim 1, further comprising at least one pad.

4. The caddy of claim 3, wherein the pad is a non-skid pad.

5. The caddy of claim 3, wherein the recess is on an upward-facing side of the caddy and the pad is on an underside of the caddy.

6. The caddy of claim 1, comprising a set of 10 rollers.

7. The caddy of claim 1, wherein the caddy is situated on a surface, and wherein a boxed wine product is situated in the recess with a spout of the boxed wine product pointing in a direction that wine dripping from the spout falls into the drip tray and not onto the surface.

8. The caddy of claim 7, wherein the surface is selected from the group consisting of a countertop surface, a tabletop surface, a table-clothed surface, a wooden furniture surface and a glass surface.

9. The caddy of claim 1, wherein the boxed wine product is a boxed wine product comprising a scratchy bottom that scratches a surface when slid along the surface.

10. The caddy of claim 8, wherein when the boxed wine product is separate from the caddy and slid along a surface back and forth to dispense wine, a bottom of the boxed wine product scratches the surface; but when the boxed wine product is situated in the caddy, wine is dispensed without the surface being scratched.

11. The caddy of claim 1, wherein the recess is defined only by the base and no roof section or top section is included above the recess.

* * * * *